United States Patent [19]

Stoll et al.

[11] Patent Number: 4,672,213

[45] Date of Patent: Jun. 9, 1987

[54] CONTAINER, ESPECIALLY FOR RADIOACTIVE SUBSTANCES

[75] Inventors: Wolfgang Stoll; Ralf Güldner, both of Hanau, Fed. Rep. of Germany

[73] Assignee: Alkem GmbH, Hanau, Fed. Rep. of Germany

[21] Appl. No.: 675,515

[22] Filed: Nov. 28, 1984

[30] Foreign Application Priority Data

Nov. 29, 1983 [DE] Fed. Rep. of Germany ..... 3343166

[51] Int. Cl.[4] ..... G21F 5/00

[52] U.S. Cl. ..... 250/506.1; 376/283; 376/272

[58] Field of Search ..... 250/506.1; 376/283, 376/255, 272, 298

[56] References Cited

U.S. PATENT DOCUMENTS

| | | | |
|---|---|---|---|
| 3,230,373 | 1/1966 | Montgomery | 250/506.1 |
| 3,391,280 | 7/1968 | Bonilla et al. | 250/506.1 |
| 3,453,176 | 7/1969 | Ling | 376/283 |
| 3,666,616 | 5/1972 | Schluderburg | 376/283 |
| 4,167,968 | 9/1979 | Wietelmann | 376/283 |
| 4,470,950 | 9/1984 | Hyde | 250/506.1 |

*Primary Examiner*—Bruce C. Anderson

*Attorney, Agent, or Firm*—Herbert L. Lerner; Laurence A. Greenberg

[57] ABSTRACT

Container, especially for radioactive substances such as radioactive liquids, with an inner container for receiving these substances and an outer container, in which the inner container and thermal insulation between the inner and outer container are located. The inner container is associated with a cooling tube within the outer container which tube contains a coolant that can be circulated. A heat discharge tube likewise containing the coolant that can be circulated is arranged at the outer container. The cooling tube and the heat discharge tube are in communication with each other via connecting lines at both tube ends.

11 Claims, 3 Drawing Figures

CONTAINER, ESPECIALLY FOR RADIOACTIVE SUBSTANCES

BACKGROUND OF THE INVENTION

1. Field of the Invention

The invention relates to a container, especially for radioactive substances such as radioactive liquids, with an inner container for receiving the substances, an outer container which contains the inner container and thermal insulation between the inner and the outer container.

2. Description of the Prior Art

Such a container is already in use. The thermal insulation between the inner and the outer container consists, for instance, of phenolic resin foam. The purpose of the foam insulation, in the event of a fire, is to prevent heat from the outside from entering into the inner container to cause a sudden rise in the pressure in the inner container, which may ultimately result in the bursting of this inner container and the escape of the radioactive substances. The thermal insulation between the inner and the outer container, however, prevents the escape of decay heat of the radioactive substances to the outside. The capacity of this container is very limited since in the course of time, with output of decay heat, a heat accumulation could occur which would lead to excessive high pressure in the inner container.

SUMMARY OF THE INVENTION

An object of the invention is to provide a container which is not limited in capacity with respect to radioactive substances or at least has increased capacity in this regard.

With the foregoing and other objects in view, there is provided in accordance with the invention a container, especially adapted for enclosing radioactive substances such as radioactive liquids, which comprises; an inner container for receiving a substance to be contained, an outer container in which the inner container is disposed, and thermal insulation between the inner container and the outer container, in combination with a coolant tube associated with the inner container disposed within the outer container, said coolant tube containing a fluid coolant which can be circulated, a heat-discharge tube which also contains the coolant arranged at the outer container, and connecting lines at both tube ends of the cooling tube and the heat discharge tube through which said cooling tube and said heat discharge tube are in communication with each other.

Other features which are considered as characteristic for the invention are set forth in the appended claims.

Although the invention is illustrated and described herein as embodied in a container, especially for radioactive substances, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

To overcome the dangers and difficulties resulting from decay heat of the radioactive substances as well as external heat, particularly high temperature heat such as fires, a container of the type mentioned at the outset is characterized, according to the invention, by the features that within the outer container a cooling tube containing a coolant capable of being circulated is associated with the inner container; that a heat discharge tube which likewise contains the coolant capable of being circulated is arranged at the outer container; and that the cooling tube and the heat discharge tube are in communication with each other at both tube ends via connecting lines.

In this manner, the decay heat of the radioactive substances in the inner container of the container can be transported through the thermal insulation to the outside by natural circulation of the coolant capable of being circulated and be given off there. In spite of this, the thermal insulation protects the inner container against sudden temperature rises in the event of a fire.

It is advantageous if a feedthrough with a pressure relief valve or a rupture disc is provided in a wall of the cooling tube, the heat discharge tube and/or the connecting lines. This coolant, particularly when employing a gaseous coolant, can escape from the cooling tube, the heat discharge tube and the connecting lines because of the temporarily increased ambient temperature by actuating the pressure relief pressure valve or by breaking the rupture disc, and consequently, the coolant cannot contribute to transporting heat from the outside to the inner container.

It may also be advantageous if the cooling tube, the heat discharge tube and/or the connecting lines have a feedthrough in the wall which is sealed with a solder. The melting temperature of the solder should be lower than the melting temperature of the material of the cooling tube, the heat discharge tube or the connecting lines. At an increased ambient temperature such as would probably occur in the event of a fire, this solder melts and bursts. As a result, the coolant, especially a liquid coolant, flows through the opening formed by the melted solder out of the cooling tube, the heat discharge tube and the connecting tubes and the coolant can no longer transport heat from the outside to the inner container.

Since the capacity of the container for radioactive substances is determined practically only by the volume of the inner container, which can be chosen as large as desired, it is advantageous if in the interior of the inner container a body of a material is arranged which can actively absorb neutrons. This prevents a critical configuration of fissionable radioactive substances in the inner container from coming about.

The invention and its advantages will be explained in greater detail by an embodiment example, with reference to the drawings.

Figure 1:
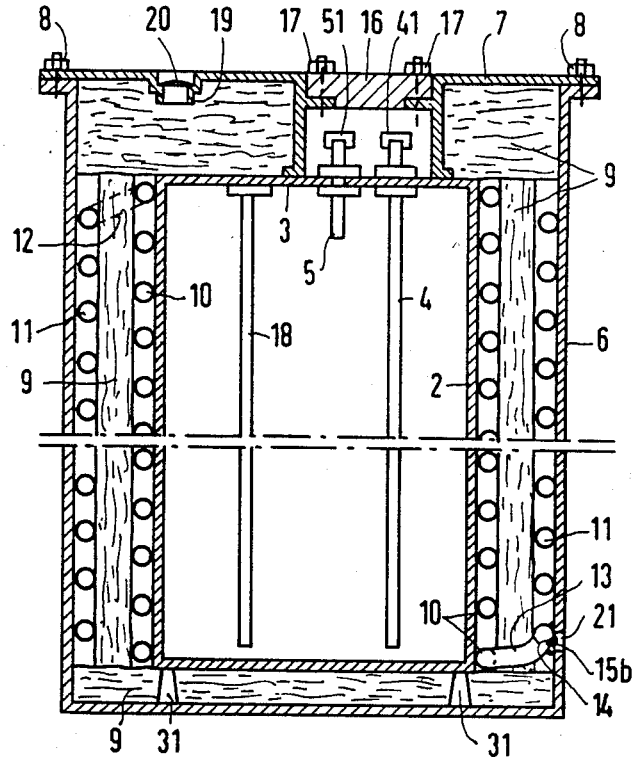
FIG. 1 shows a longitudinal section through a transport or storage container together with a cooling system to protect against problems resulting from decay heat of radioactive substances in the container as well as sudden high heat outside the container such as in the event of a fire, according to the invention.

The container according to FIG. 1 includes an inner container 2 of steel and an outer container 6, likewise of steel. The inner container 2 is sealed on all sides gas- and liquid-tight and stands on the inside on the bottom of the outer container 6 via support bodies 31. Extending through the top side wall 3 of container 2 are a loading and unloading tube 4 with a closing cap 41 and a venting and exhaust tube 5 with closing cap 51. The outer container 6 is also sealed gas- and liquid-tight on all sides other than the top which is sealed by a cover 7 bolted to the outer container 6 with screws 8. Thermal insulation 9 which may consist of glass wool or phenolic resin foam, is disposed in the outer container 6 between the inner container 2 and the outer container 6 and its cover 7. Advantageously, the support bodies 31 consist of thermal insulation which are poor heat conductors such as ceramics.

A helical cooling tube 10 of copper is welded to the outside of the inner container 2. A similar helical heat discharge tube 11 of copper is welded to the inside of the outer container 6. The heat discharge tube may be arranged either at the outside of the outer container 2, or inserted into the outer container 2. The upper end of the cooling tube 10 is connected to the upper end of the heat discharge tube 11 by a connecting line 12 and the lower end of the cooling tube 10 is connected to the lower end of the heat discharge tube 11 by a connecting line 13. Thus, the cooling tube 10 and the heat discharge tube 11 are in communication with each other at both tube ends. The connecting lines 12 and 13 may also be copper tubes. To facilitate the assembly of the container, however, these connecting lines 12 and 13 can consist of plastic tubing.

Figure 2:
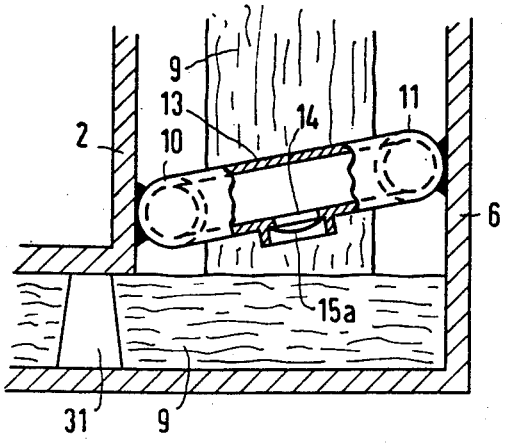
FIGS. 2 and 3 show, magnified, a section from embodiments of the transport or storage container with particular reference to feedthroughs in the connecting lines of the cooling system provided with a solder seal or a rupture disc.
Figure 3:
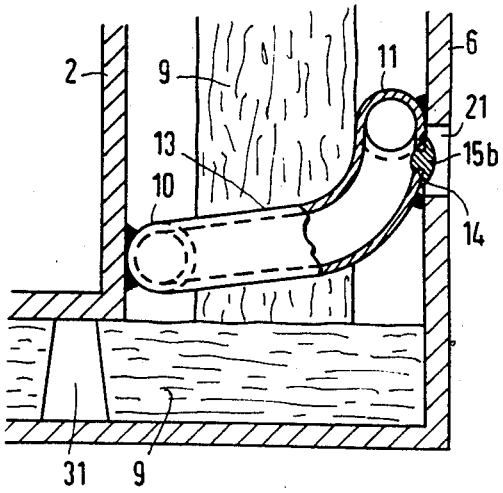

The cooling tube 10, the heat discharge tube 11 as well as the connecting lines 12 and 13 are filled with a coolant that can be circulated, for instance, with a gaseous fluorinated hydrocarbon, with helium or with liquid water. If the coolant is gaseous, the connecting line is desirably provided with a rupture disc 15*a* in a feedthrough 14 in the wall, as shown in FIG. 2. When using a liquid coolant, a feedthrough 14 is provided in the wall in the connecting line 13, which feedthrough opening, as shown in FIGS. 1 and 3, is sealed with a solder 15*b* of a lead-tin alloy. The feedthrough 14 with the rupture disc 15*a*, as shown in FIG. 2, opens into the interior of the outer container 6. However, the feedthrough 14 in FIGS. 1 and 3, sealed with the solder 15*b*, leads through a feedthrough 21 in the side wall of the outer container 6 to the outside of the outer container 6. The feedthrough 21 in the outer container 6 is sealed under normal operating conditions, gas- and liquid-tight by the heat discharge tube 11 which is welded on the inside to the outer container.

The cover 7 has a loading and unloading cover 16 over the loading and unloading tube 4 and the venting and exhaust tube 5. Cover 16 is bolted to the cover 7 by screws 17. A steel tube 18 is attached to the top side 3 in the interior of the inner container 2. The steel tube 18 is closed at both ends and is filled with boron carbide which absorbs neutrons and prevents a critical configuration of fissionable radioactive substances. The cover 7 is also provided with a feedthrough 19 which, in turn, is closed off by a rupture disc 20.

To load the inner container 2 with a liquid nitric acid plutonium nitrate solution, the loading cover 16 is removed by unscrewing screws 8 fastening the cover 7 to the outer container 6. The loading and unloading tube 4 as well as the venting and exhaust tube 5 are then connected to a loading station (not shown). As soon as the inner container 2 is filled with the plutonium nitrate solution, the loading and unloading tube 4 and the venting and exhaust tube 5 are decoupled from the unloading station and closed off gas- and liquid-tight by the closing caps 41 and 51. The loading cover 16 is returned by bolting to the cover 7 of the outer container 6. The decay heat developed in the plutonium nitrate solution sets in operation a natural circulation in the cooling system formed by the cooling tube 10, the heat discharge tube 11 and the connecting lines 12 and 13, as a result of which decay heat is transported to the outer container 6 and is radiated thereby or carried off by convection or conduction, or all of them.

In the event of a fire, the temperature on the outside of the outer container 6 increases suddenly. The thermal insulation 9 prevents this external heat from getting immediately from the outside to the inner container 2 and the plutonium nitrate solution from being additionally heated in the inner container 2. The coolant in the heat discharge tube 11 is heated by this external heat. With the use of a gaseous coolant, the heated gaseous coolant expands, thereby increasing the pressure in tube 11 and line 13 causing the rupture disc 15*a* shown in FIG. 2 to burst. With the use of a liquid coolant, the solder 15*b* shown in FIGS. 1 and 3 melts because of the increased ambient temperature. Upon rupture of rupture disc 15a, the gaseous coolant, discharges into the interior of the outer container 6 and, if the pressure therein is sufficiently high will cause the rupture disc 20 to burst and permit the gaseous coolant to escape to the outside through the feedthrough 19. In the case of a liquid coolant, the latter immediately flows through the feedthroughs 14 and 21 to the outside of the outer container 6. In both cases, heat can no longer get from the outside via the cooling system formed by the cooling tube 10, the heat discharge tube 11 and the connecting lines 12 and 13 to the inner container 2.

After the effect of the fire has ceased, which is brought about in a relatively short time, so that an excessive build-up of decay heat in the inner container cannot be expected, either the inner contents of container 2 is discharged or the cooling system consisting of the cooling tube 10, the heat discharge tube 11 and the connecting lines 12 and 13 is put in operation again by closing the feedthroughs 14 and filling in coolant.

The cooling effect of the cooling system which includes the cooling tube 10, the heat discharge tube 11 and the connecting lines 12 and 13 can be increased still further if a cooling unit is connected to the connecting lines 12 and 13 or to the heat discharge line 11 to connecting nozzles, not shown.

The inner container 2 can further be surrounded by a radiation shield for shielding-off radioactive radiation. The radiation shield is located in the outer container 6, but is not shown in the drawing for greater clarity.

Advantageously, the inner container may be equipped with a pressure relief valve opening into the outer container 6 which is arranged in a feedthrough in the wall preferably at the upper part of the inner container. Such a pressure relief valve is intended to include a capillary feedthrough through the wall of the inner container, which feedthrough is closed off by a solder, for instance, a lead-tin alloy. If the temperature and the pressure are too high, the solder in the capillary feedthrough melts and/or bursts. If the pressure in the inner container becomes excessively high, for instance, by the formation of radiolysis gas nevertheless, this excessive pressure can be reduced by the pressure relief valve which will bleed off gas and reduce excessive pressure and thereby prevent rupture of the inner container 2.

It may further be advantageous if absorption bodies for taking up and/or absorbing substances which passed from the inner container into the outer container, are disposed in the outer container outside of the inner container. These absorbing bodies are to absorb or take up radioactive aerosol or radioactive liquid which may escape from the inner container, for instance, through its pressure relief valve and to optionally neutralize it. Such absorption bodies may consist, for instance, of silica gel, expanding mica or diatomaceous earth which contains, for instance, calcium hydroxide, cyanide or alkaline cement finely distributed, as an agent for neutralizing nitric acid, in which plutonium is dissolved and which may be contained in the inner container. It may be of advantage if the absorbing body is laid-out to absorb, take up or neutralize the entire quantity of the substance which can be accommodated in the inner container, without danger of criticality.

The foregoing is a description corresponding, in substance, to German patent application No. P 33 43 166.3, dated Nov. 29, 1983, international priority of which is being claimed for the instant application, and which is hereby made part of this application. Any material discrepancies between the foregoing specification and the specification of the aforementioned corresponding German application are to be resolved in favor of the latter.

There is claimed:

1. Container, especially adapted for enclosing radioactive substances such as radioactive liquids, which comprises; an inner container for receiving a substance to be contained and sealed gas and liquid tight under normal operating conditions, an outer container in which the inner container is disposed, and thermal insulation between the inner container and the outer container, in combination with a closed tubular circulating system comprising a coolant tube associated with the inner container disposed within the outer container, said coolant tube containing a fluid coolant which circulates through the coolant tube out of direct contact with the substance in the inner container, a heat-discharge tube which also contains the coolant arranged along the inner wall of the outer container with said thermal insulation between said cooling and heat discharge tubes with each other to permit circulation of the coolant from the coolant tube to the heat-discharge tube and return of the coolant from the heat-discharge tube to the coolant tube.

2. Container according to claim 1, wherein the cooling tube is attached to the outside of the inner container.

3. Container according to claim 1, wherein a feed-through with a pressure relief valve or a rupture disc is provided in the wall of at least one of the cooling tube, the heat discharge tube and the connecting lines.

4. Container according to claim 1, wherein a feed-through which is closed-off by a solder, the melting temperature of which is lower than the melting temperature of the material of the cooling tube, the heat discharging tube and the connecting lines, is provided in the wall of at least one of the cooling tube, the heat discharge tube and the connecting lines.

5. Container according to claim 3, wherein the feed-through opens to the outside of the outer container.

6. Container according to claim 4, wherein the feed-through opens to the outside of the outer container.

7. Container according to claim 1, wherein a connecting nozzle for a cooling unit is provided at the connection lines.

8. Container according to claim 1, wherein a connecting nozzle for a cooling unit is provided at the heat discharge tube.

9. Container according to claim 1, wherein in the interior of the inner container, a body of a material which readily absorbs neutrons is arranged.

10. Container according to claim 1, wherein the inner container is provided with a pressure relief valve leading into the outer container.

11. Container according to claim 1, wherein an absorption body is located in the outer container, outside the inner container for taking up substances which have escaped from the inner container into the outer container.

* * * * *